United States Patent [19]

Glaesener

[11] 3,963,218

[45] June 15, 1976

[54] VEHICLE GUARDRAIL WITH METAL CORE

[75] Inventor: Ernest Glaesener, Dudelange, Luxembourg

[73] Assignee: Acieries Reunies de Burbach-Eich-Dudelange S.A. ARBED, Luxembourg, Luxembourg

[22] Filed: June 26, 1973

[21] Appl. No.: 373,867

[30] Foreign Application Priority Data

June 29, 1972 Germany ..... 2231763

[52] U.S. Cl. ..... 256/13.1; 404/6; 256/1

[51] Int. Cl.[2] ..... E01F 15/00

[58] Field of Search ..... 256/13.1, 1; 404/6–9; 52/309

[56] References Cited

UNITED STATES PATENTS

| | | | |
|---|---|---|---|
| 685,318 | 10/1901 | Bell | 52/723 |
| 724,462 | 4/1903 | Garrettson | 52/723 X |
| 1,412,096 | 4/1922 | Emperger | 52/723 |
| 1,526,069 | 2/1925 | Irving | 52/723 X |
| 2,895,302 | 7/1959 | McKnight | 256/59 X |
| 3,170,967 | 2/1965 | Williams et al. | 49/489 X |
| 3,303,627 | 2/1967 | Mota | 52/723 |
| 3,404,526 | 10/1968 | Thomas | 256/13.1 X |
| 3,480,493 | 11/1969 | Bauer et al. | 264/45 UX |
| 3,484,509 | 12/1969 | Keller | 264/45 |
| 3,591,144 | 7/1971 | Irving | 256/13.1 |
| 3,603,562 | 9/1971 | Glaesener | 256/13.1 |
| 3,644,168 | 2/1972 | Bonk et al. | 264/45 |
| 3,765,360 | 10/1973 | Monfort | 52/309 |

FOREIGN PATENTS OR APPLICATIONS

| | | | |
|---|---|---|---|
| 2,028,295 | 12/1971 | Germany | 404/6 |
| 1,658,664 | 12/1970 | Germany | 256/13.1 |
| 7107390 | 12/1971 | Netherlands | 256/13.1 |

*Primary Examiner*—Dennis L. Taylor
*Attorney, Agent, or Firm*—Karl F. Ross

[57] ABSTRACT

A guardrail has a core formed of steel plate, sheet or strip having at least two planar sections lying in mutually intersecting planes. Several intersecting planar steel plates may be welded together in a star-shaped or box-girder configuration. A mass of nonporous synthetic-resin foam surrounds this core to protect it against corrosion. This mass also acts as a cushion and serves to stiffen the rail. The steel members have a thickness between 0.2 and 2.5 mm thick, and the synthetic-resin sheath is a polyurethane structure foam with a density of between 40 and 100 kg/m$^3$.

9 Claims, 5 Drawing Figures

VEHICLE GUARDRAIL WITH METAL CORE

1. CROSS-REFERENCE TO RELATED APPLICATION

This application is related to my application Ser. No. 296,653 filed Oct. 11, 1972 (now U.S. Pat. No. 3,784,167) and to the prior applications referred to therein.

2. FIELD OF THE INVENTION

The present invention relates to a vehicle-roadway guardrail and, more particularly, to a guardrail formed of synthetic-resin foam and steel and constituting an improvement over the structures described in the earlier application.

3. BACKGROUND OF THE INVENTION

In a guardrail wherein a horizontal downwardly open metal channel is filled with polyurethane foam (see the aforementioned applications), sockets are formed in the foam mass in the channel and vertical posts are received in these pockets, spaced apart by at least 10 meters. In this arrangement it is necessary to galvanize or otherwise protect the exposed surfaces of the metal channel from corrosion. In another known arrangement, heavy cables are tightly stretched between posts. The cables are covered with synthetic-resin bodies which protect the cable and cushion shocks against it. Such an arrangement is difficult to set up, and offers only nominal resistance to deflection.

4. OBJECTS OF THE INVENTION

It is, therefore, an object of the present invention to provide an improved guardrail.

Another object is the provision of a guardrail with improved stiffness and resistance to bending, and which also is simple and inexpensive to manufacture.

A further object is to provide a guardrail which is easily assembled in place and which has a long service life.

5. SUMMARY OF THE INVENTION

These objects are attained according to the present invention in a guardrail having a metal core with a plurality of sections each lying in a respective longitudinal plane, these planes intersecting one another. This core is surrounded by a mass of synthetic-resin foam.

The core can be formed of a single piece of sheet steel which is bent along a longitudinal axis which defines the two sections. Alternatively or in addition several pieces can be welded together to give the core a cruciform or even closed cross section. Such a core is quite stiff. Furthermore, when combined with a rigid synthetic-resin mass the resultant structure is extremely resistant to bending.

The mass surrounding the core is a closed-pore polyurethane foam (structure foam) having a smooth nonporous skin. This mass prevents any moisture from penetrating to the core and corroding it, so that this core may be made of inexpensive black steel, this is uncoated mild steel capable of rusting. Such polyurethane foam is termed "structure" foam and is quite rigid so that a motor vehicle colliding with the barrier formed by the guardrail is not likely to cut through the encapsulating mass readily, nor is this mass readily driven aside to expose the edges of the core.

In accordance with further features of the invention, the sections of the core are formed with throughgoing holes which permit the foam to bond intimately all around this core. In addition, such holes permit the core to be readily held together as it is welded and afterwards encapsulated in the foam mass.

6. DESCRIPTION OF THE DRAWING

The above and other objects, features, and advantages will become more readily apparent from the following description, reference being made to the accompanying drawing in which.

7 SPECIFIC DESCRIPTION

Figure 1:
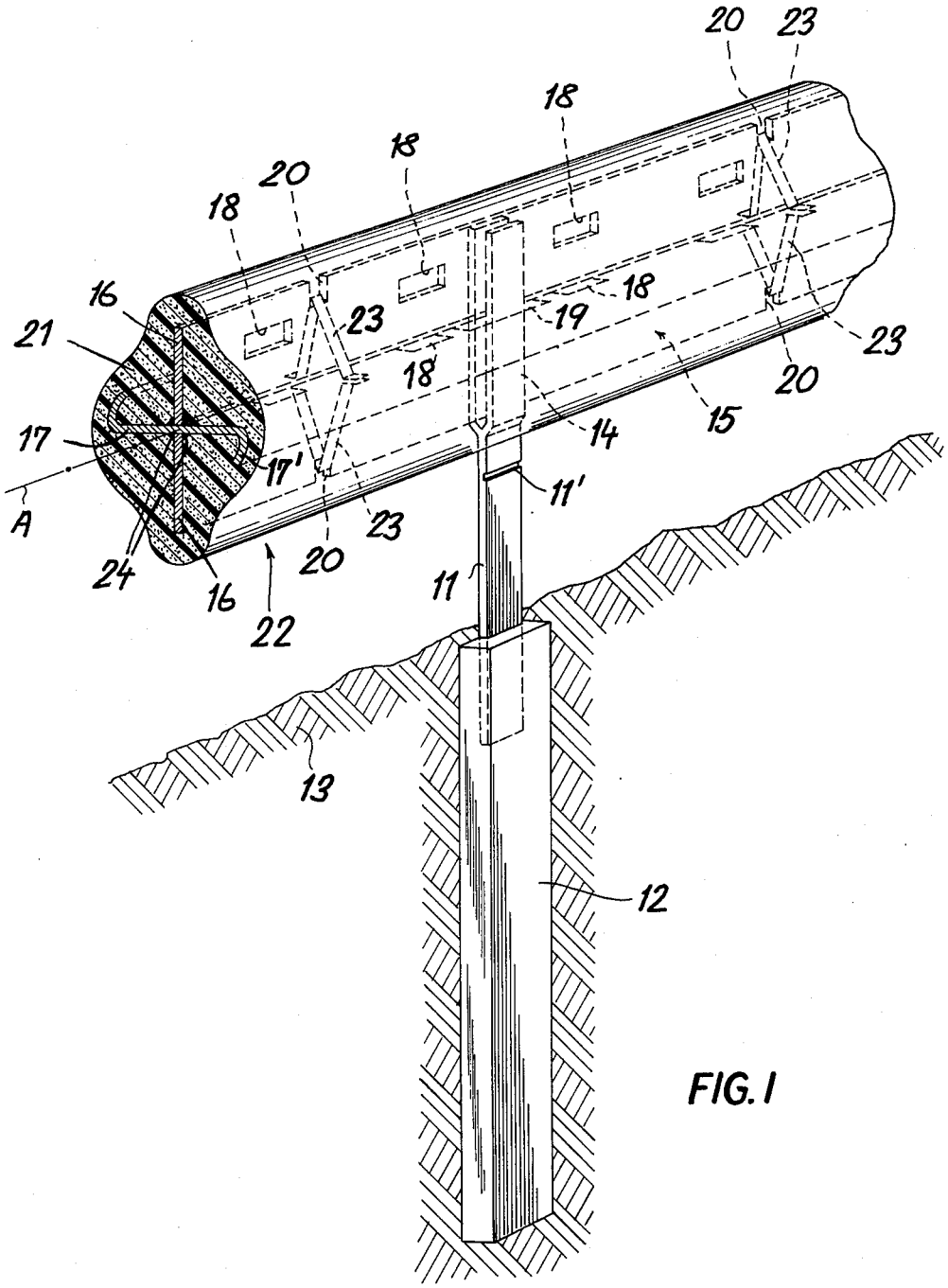
FIG. 1 is a perspective view, partly in section and with parts broken away, showing a first embodiment of the guardrail according to the present invention.

As shown in FIG. 1, a guardrail 22 is supported every 15 meters on a post 11 sunk in a block 12 of concrete embedded in the ground 13. The guardrail 22 comprises a unitary sheetmetal core 15 of angularly adjoining plates completely surrounded by and embedded in a mass 21 of synthetic resin, here closed-cell polyurethane structure foam which fills all spaces within the core structure including the angles included between the plates.

The core 15 comprises a horizontal central plate 17 formed with bent-over longitudinal edges 17', imparting to it an S-shape. A pair of vertical steel plates 16 are welded to either face of this element 17 to give the core 15 a cruciform cross section. The plates 16 and 17 are formed with throughgoing rectangular holes 18.

The plate 17 is formed every 15 meters with a central hole 19 through which an upper forked end 14 of the post 11 passes, its sides embracing the two plates 16. It is possible to provide a post 11 which is pivotal about a horizontal axis transverse to the axis A of the guardrail as described in the copending commonly assigned U.S. Pat. Application Ser. No. 296,643 filed Oct. 11, 1972. The post 11 here is formed with a weakened region 11' at which it breaks in case of a sudden force transverse to axis A. The guardrail therefore absorbs force along its entire length as discussed in the above-cited patent application.

In addition, the plates 16 are formed with equispaced notches 20 and the plate 17 with similarly spaced and adjoining holes 20' so that a steel strap 23 can be tightly spanned through these cutouts 20 and 20' during assembly of the core 15. Bead or fillet welds 24 are formed between the plates 16 and 17 to secure them together.

The core 15 is, as described above, encapsulated in a mass 22 of structure polyurethane foam of generally cruciform cross section which bonds intimately to the plates 16 and 17, passing through the holes 18 for a tight integral adhesion. This encapsulation is carried out at the factory, and the guardrail sections are set on the posts at the erection site.

Figure 2:
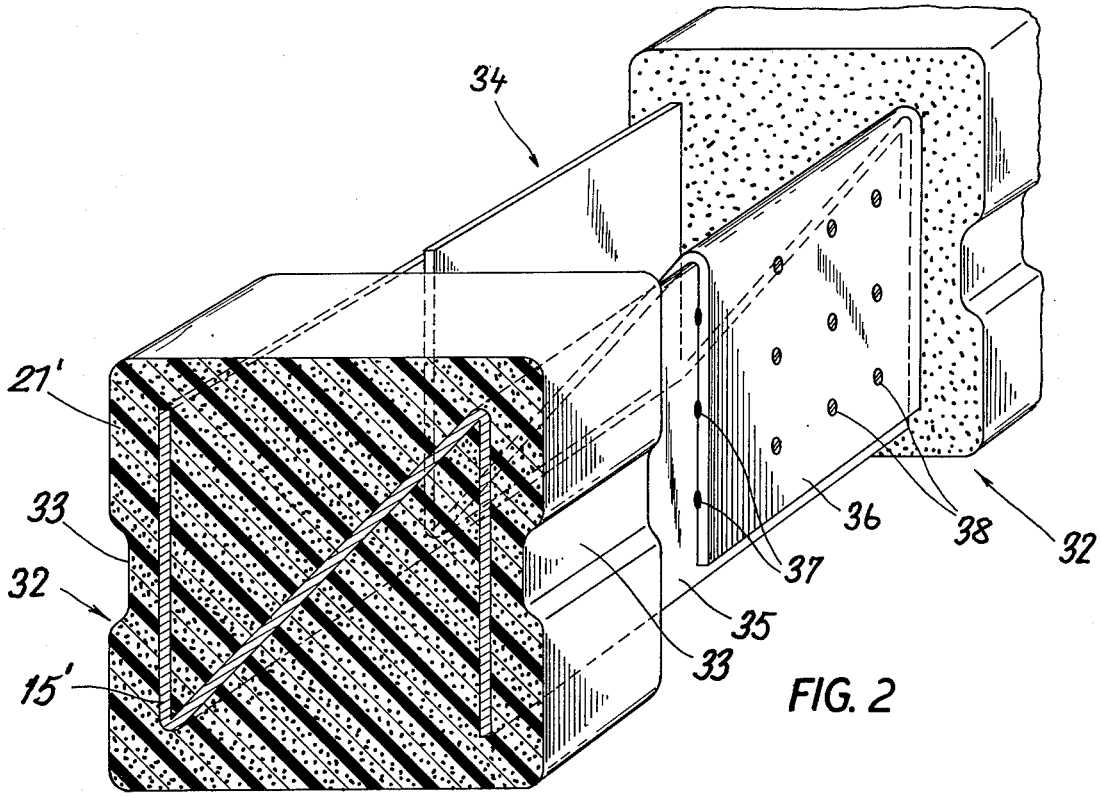
FIGS. 2 and 3 are partly sectional perspective views of other embodiments of this invention.

FIG. 2 shows another guardrail structure wherein two identical guardrail sections 32 have identical N-section cores 15' which project from the longitudinal ends of the sections 32 as shown at 35 and 36. These cores 15' are received in generally square-section masses 21' of polyurethane foam formed with lateral longitudinally extending grooves 33.

For installation the two projecting end sections 35 and 36 are overlapped and spot-welded together as shown at 37 with self-tapping screws 38 or rivets employed to ensure a good connection. Thereafter a form is fitted around the ends 35 and 36 and an expandable flowable polyurethane-foam compositon is injected into the form and allowed to harden. This operation is carried out in situ to form a continuous guardrail.

Figure 3:
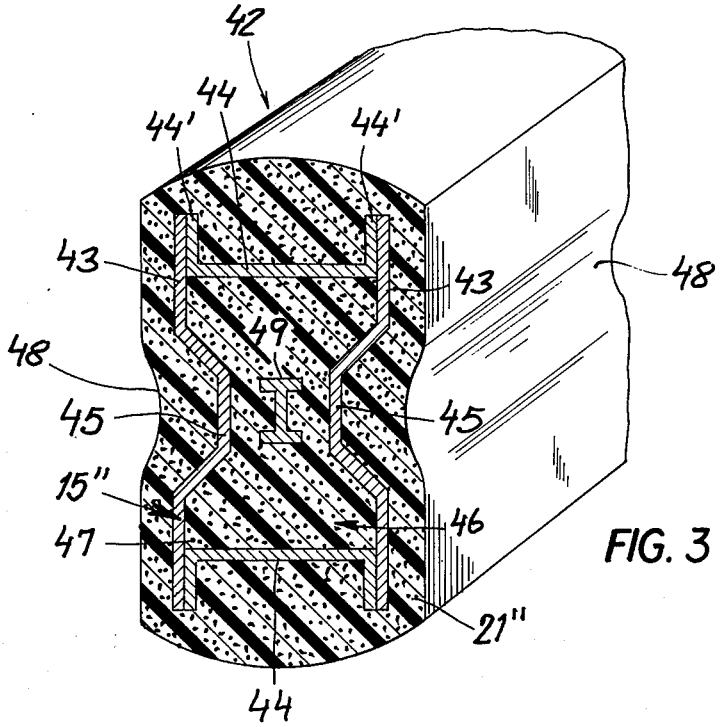

In FIG. 3 a guardrail 42 is shown which has a core 15'' formed of two U-shaped upper and lower plates 44 having upturned edges 44' secured by welding to two side plates 43 each formed centrally with a horizontal longitudinally extending depression 45. These core elements 43 and 44 define a closed inner space 47 filled with a mass 46 of polyurethane foam. In addition the core 15'' is surrounded by a mass 21'' of similar foam formed with longitudinally extending grooves 48. The elements 43 and 44 form a box girder which is highly resistant to bending, especially when filled with the rigid foam mass 46. The grooves 48, like the grooves 33 of FIG. 2, tend to prevent a vehicle colliding with the guardrail from sliding over or jumping it. A steel profile element 49, here an I-beam, may be used in addition to or instead of the core 15''.

Figure 4:
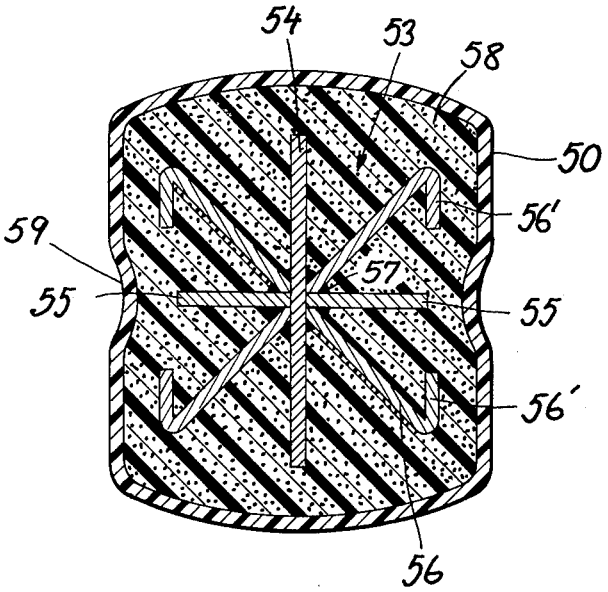
FIGS. 4 and 5 are cross sections through still further embodiments of the present invention.

The rail shown in FIG. 4 has a core 53 formed of an upright plate 54 to which are welded two horizontal plates 55. Further stiffening plates 56 with edges 56' bent over and extending vertically extend as diagonals to the plates 54 and 55, with welds 57 securing the group together, giving a star-shape section. This core 53 is imbedded in a synthetic-resin mass 58 contained in an outer synthetic-resin tube 50 formed with longitudinally extending lateral grooves 59. The plates 54–56 are inexpensive "black" steel, i.e., nongalvanized corrodible steel, while the outer element 50 is formed of a synthetic-resin such as a poliptyrene. Such a structure offers extreme rigidity for light weight and low production costs.

Figure 5:
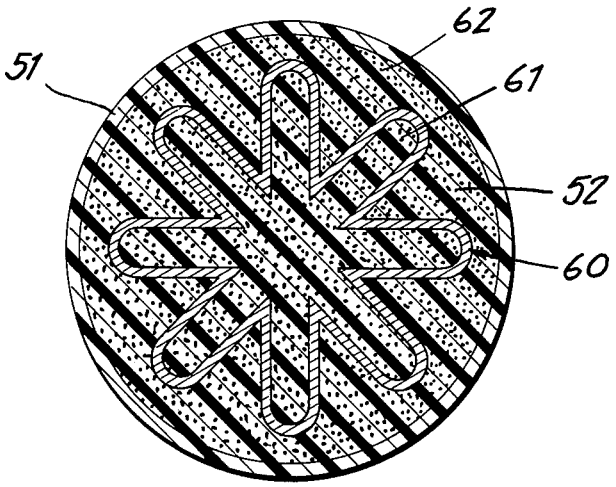

In FIG. 5 a one-piece star-section core 60 is filled with a polyurethane mass 61 and is in turn embedded in a similar mass 52 having an outer skin 51 impervious to moisture. This type of guardrail offers the same resistance to bending in every direction.

The metal elements used as cores advantageously have a thickness of between 0.2 mm and 2.5 mm, the arrangements shown above using steel of a thickness of 1.2 mm. Simple black or mild steel is used since it is inexpensive and easy to work with. In addition the foam adheres better to such steel than to, for example, galvanized steel.

The foam used is, as described above, polyurethane and has a density of between 40 and 100 kg/m$^3$ is employed. Even at this relatively low density considerable rigidity is obtained. This foam forms a smooth nonporous skin that completely prevents moisture from entering. In case another resin is employed which would permit moisture to penetrate to the corrodible steel core, it is possible to paint the rail's exterior or fill the cores of the foam sheath.

I claim:

1. A continuous guardrail assembly comprising: a flexible rail consisting of a core and a sheath, said core comprising a continuous elongated metal core structure of sheet metal of longitudinally extending angularly adjoining plate sections respectively lying in mutually intersecting longitudinal planes, said sheath comprising a continous mass of synthetic-resin foam surrounding said core structure, said structure being fully embedded in said foam mass and said mass completely filling said structure; and a plurality of breakaway posts supporting said structure at predetermined intervals, said core structure and said posts being formed with mating means adapted to enable said structure to receive said posts.

2. The guardrail defined in claim 1 wherein said core structure is formed of at least one mild-steel plate.

3. The guardrail defined in claim 2 wherein said core structure is formed of at least two substantially planar plates, said core structure further comprising welds interconnecting said plates.

4. The guardrail defined in claim 3 wherein said core structure is of generally cruciform section.

5. The guardrail defined in claim 3 wherein said core structure is of closed section, said core structure enclosing synthetic-resin foam filling said core structure.

6. The guardrail defined in claim 2 wherein said plate is bent along a longitudinal horizontal axis.

7. The guardrail defined in claim 1 wherein said foam is of the water-impervious closed-pore type.

8. The guardrail defined in claim 1, further comprising a synthetic-resin sleeve surrounding and containing said mass.

9. The guardrail defined in claim 1 wherein said core structure is formed of a pair of steel elements of like section having overlapping ends fastened together, said mass comprising a respective first mass surrounding each one of said elements with the respective end projecting, and a second mass between said first masses and encapsulating said ends.

* * * * *